US007597439B2

(12) United States Patent
Wexler et al.

(10) Patent No.: US 7,597,439 B2
(45) Date of Patent: Oct. 6, 2009

(54) INKJET PRINT AND A METHOD OF PRINTING

(75) Inventors: Allan Wexler, Pittsford, NY (US); Bruce C. Campbell, Webster, NY (US); Gregory E. Missell, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 735 days.

(21) Appl. No.: 11/173,706

(22) Filed: Jul. 1, 2005

(65) Prior Publication Data

US 2007/0003713 A1 Jan. 4, 2007

(51) Int. Cl.
*B41J 2/01* (2006.01)

(52) U.S. Cl. ..... 347/105; 347/101; 428/32.1

(58) Field of Classification Search ..... 347/100, 347/95, 101, 105; 428/195, 32.1
See application file for complete search history.

(56) References Cited

U.S. PATENT DOCUMENTS 4,785,313 A 11/1988 Higuma et al.
4,832,984 A 5/1989 Hasegawa et al.
6,550,909 B2 4/2003 Ichinose et al.
6,569,533 B1 * 5/2003 Uchida et al. ..... 428/423.1
6,695,447 B1 2/2004 Wexler
6,814,437 B2 * 11/2004 Wexler ..... 347/105
6,866,384 B2 * 3/2005 O'Connor et al. ..... 347/105
7,264,856 B2 * 9/2007 Wexler et al. ..... 347/105
2002/0089568 A1 7/2002 King et al.

FOREIGN PATENT DOCUMENTS

EP 1 502 759 A1 2/2005

* cited by examiner

*Primary Examiner*—Manish S Shah
(74) *Attorney, Agent, or Firm*—Chris P. Konkol; Arthur E. Kluegel; Andrew J. Anderson

(57) ABSTRACT

A method of printing on an inkjet recording element having a support having thereon in order: a) a porous upper fusible layer of fusible polymeric materials and a binder, b) a porous ink-receiving layer in which pigmented ink is stratified such that, after fusing the printed element, greater than 50% of the printed pigment colorant particles in the inkjet ink composition is retained in the bottom half of the upper porous fusible layer.

20 Claims, 1 Drawing Sheet

INKJET PRINT AND A METHOD OF PRINTING

FIELD OF THE INVENTION

The present invention relates to an image recording element and a printing method using the element. More specifically, the invention relates to a recording medium in which the top layer comprises fusible particles.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof at least one ink-receiving layer. The ink-receiving layer is typically either a porous layer that imbibes the ink via capillary action, or a polymer layer that swells to absorb the ink. Transparent swellable hydrophilic polymer layers do not scatter light and therefore afford high image density and gamut, but tend to take longer time to dry. On the other hand, porous ink-receiving layers, which usually comprise inorganic or organic particles and a binder, can rapidly absorb ink droplets into the coating through capillary action, during the inkjet printing process, so that the image is dry-to-touch right after it comes out of the printer. Therefore, porous layers allow a fast "drying" of the ink and produce a smear-resistant image. However, such porous layers, by virtue of the large number of air-particle interfaces, tend to scatter light, which can result in lower densities of printed images.

Elements that comprise two distinct layers have been constructed which have an uppermost porous layer and an underlying swellable polymer layer. Such constructions suffer from poor image quality, however, as the rate of ink absorption in the upper porous layer via capillary action is orders of magnitude faster than absorption by ink diffusion into the swellable layer. This difference in absorption rates leads to unwanted lateral spreading of ink in the uppermost layer when the ink fluid reaches the interface between the layers. This unwanted lateral diffusion of the ink is a phenomenon known in the art as bleed.

Inkjet prints, prepared by printing onto inkjet recording elements, are subject to physical damage and environmental degradation. Dye-imaged inkjet prints on swellable media are especially vulnerable to damage resulting from contact with water. The damage resulting from the post-imaging contact with water can take the form of water spots resulting from deglossing of the top coat, dye smearing due to unwanted dye diffusion, and even gross dissolution of the image recording layer. On the other hand, dye-imaged inkjet prints on porous media are especially vulnerable to damage resulting from contact with atmospheric gases such as ozone. Ozone can bleach inkjet dyes resulting in loss of density. Pigment-imaged inkjet prints on porous media are relatively more robust against atmospheric gases, but can be easily smudged by rubbing the still moist surface of the pigmented image. Pigment-imaged inkjet prints are also subject to surface scratching and abrasion defects as the pigmented image generally resides on the media surface. To overcome these deficiencies, inkjet prints can be laminated. However, lamination is expensive, as it requires a separate roll of material.

Efforts have been made to avoid lamination and yet provide protected inkjet prints by providing an inkjet receiver having an uppermost fusible ink-transporting layer and an underlying ink-retaining layer, with respect to the colorant in the ink, typically a transportable dye. Fusing the upper layer after printing the image has the advantage of providing a protective overcoat, for water and stain resistance, and reducing light scatter for improved image quality.

For example, U.S. Pat. Nos. 4,785,313 and 4,832,984 relate to an inkjet recording element comprising a support having thereon a porous fusible, ink-transporting layer and a swellable polymeric ink-retaining layer, wherein the ink-retaining layer is non-porous. However, there is a problem with this element in that it has poor image quality due to bleed, as mentioned above.

EP 858, 905A1 relates to an inkjet recording element having a porous fusible ink-transporting outermost layer formed by heat sintering thermoplastic particles, and an underlying porous layer to absorb and retain the ink applied to the outermost layer to form an image. The underlying porous ink-retaining layer is constituted mainly of refractory pigments. After imaging, the outermost layer is made non-porous. There are problems with this element in that the ink-retaining layer remains light scattering and, therefore, fused prints suffer from low density. Also, the sintered outermost layer has poor abrasion resistance.

EP 1,188,573 A2 relates to a recording material comprising in order: a sheet-like paper substrate, at least one porous pigment layer coated thereon, and at least one sealing layer coated thereon. Also disclosed is an optional dye trapping layer present between the porous pigment and sealing layers. There are several problems with this element in that the binder in the sealing layer is water-soluble which degrades the water resistance of sealed prints. While the sealing layer is porous, the dye trapping layer is not, which leads to bleed and degraded image quality.

U.S. Pat. No. 6,695,447 to Wexler discloses inkjet media comprising a support having thereon, in order, at least one porous ink-receiving layer, a fusible porous dye-trapping layer (comprising fusible polymeric particles, a binder, and a dye mordant), and a fusible porous ink-transporting layer comprising fusible, polymeric particles and a film-forming hydrophobic binder. The particle sizes of the layers are chosen to provide a pore size hierarchy facilitating fluid transport from the ink transporting layer, through the porous dye-trapping layer and into the porous ink receiving layer. After printing and fusing, this element provides a print with sub-surface image protected from abrasion. An element with fewer layers would be preferred from a manufacturing standpoint. The latex dispersion of polymeric mordant may tend to reduce porosity upon swelling during printing.

EP 743,193 A1 discloses a transparent image-recording medium in which the printing and viewing surfaces are situated on opposite sides of the support and in which the recording surface comprises, in order from the transparent support, an ink-retaining layer and a liquid-permeable surface layer. This medium is designed to pass pigmented ink through the ink-permeable layer, but is not intended for viewing from the printed side. Moreover, the ink-permeable layer is not fusible.

U.S. Pat. No. 6,550,909 B2 discloses an inkjet recording element in which the frequency distribution of pore diameter of the pores of the porous fusible layer overlaps the frequency distribution of the particle size of the ink colorant, wherein the overlap portion is from 0.1% to 10% and, furthermore, wherein the pore diameter of all the pores of the porous layer is within a range of 10 to 300 nm. Most of the colorant particles are, therefore, larger than most of the pore diameters. Accordingly, a printing method employing this element with pigmented inks traps the ink-pigment particles within 5 microns of the surface of the recording medium. Images formed by surface-trapped particles, however, are subject to damage from abrasion of the print surface. In a comparative example, in which the overlap of pore size frequency distribution and ink particle size distribution was 58%, a poor optical density was obtained. In this example, the low optical density may be explained by assuming the ink pigment has penetrated deeply enough that light scattering reduces the optical density.

U.S. Pat. No. 6,811,253 discloses a method of printing to a medium comprising an upper layer that is capable of forming a upper protective layer. After printing, the medium is heated to fuse the upper layer to form a protective layer. The printed image is substantially retained within the upper protective layer. FIG. 1 of U.S. Pat. No. 6,811,253 shows the pigmented image distributed about evenly throughout the upper layer. The portion of the image formed by pigment particles at or near the surface is subject to damage through abrasion.

SUMMARY OF THE INVENTION

It is an object of this invention to provide a printing method whereby a pigment-based ink is printed on a fusible recording medium that achieves a stratification or filtration effect such that the ink pigment is relatively concentrated below the surface of the medium and relatively closer to the interface between the upper fusible layer and the immediately underlying layer. It is a further object of this invention to provide a printing method wherein the fusible recording medium has a fusible uppermost layer that forms a protective layer and at least one underlying ink-fluid receiving layer. It is a further object of this invention to provide a printing method whereby upon printing, said pigment ink is stratified and concentrated in the bottom half of the fusible uppermost layer. It is yet a further object to provide an inkjet recording medium having a uppermost fusible layer and an immediately underlying ink-fluid-receiving layer such that, after a pigment-based ink is applied thereto, the median pore size of the upper fusible layer is sufficiently large to allow relative free flow of ink (colorant) pigment particles within the upper fusible layer, and such that the pore size of the underlying ink-fluid-receiving layer is sufficiently small such that the ink pigment particles are substantially excluded from said underlying layer. It is another object of this invention to provide an inkjet printing method whereby a fusible inkjet recording element is printed with a pigment-based ink and retains over half the printed pigment in the bottom half of the fusible uppermost layer, thereby affording good smudge resistance. It is a further object of this invention to fuse the fusible uppermost layer in order to provide a high-density image that exhibits good density and excellent abrasion resistance. Finally, it is an object of this method to provide an inkjet recording element that can be used in the present invention.

These and other objects are achieved in accordance with the invention, which comprises an inkjet printing method for printing a color image comprising:

a) providing an inkjet printer that is responsive to digital data signals;

b) loading the printer with a fusible inkjet recording element having a support and thereon a porous ink-fluid-receiving layer and a porous upper fusible layer, wherein the porous ink-fluid-receiving layer is an adjacent and underlying layer relative to the porous upper fusible layer, and wherein each layer is characterized by a median pore size, the median pore size of the porous upper fusible layer being greater than the median pore size of the underlying layer;

c) loading the printer with at least one inkjet pigment-based ink composition characterized by a mean pigment particle size of pigment colorant particles (wherein color includes black) in the pigment-based ink;

d) printing on the fusible inkjet recording element using the ink composition in response to the digital data signals; and e) fusing the printed element to obtain a fused upper layer, wherein the median pore sizes of the porous upper fusible layer and the underlying layer and the mean pigment particle size of the pigment colorant particles, in combination, are such that, after the ink composition is applied to the recording element, the median pore size of the porous upper fusible layer is sufficiently large and the median pore size of the underlying layer is sufficiently small that, in the printed image, the pigment colorant particles can be concentrated in the lower half relative to the upper half of the thickness of the fused upper layer and substantially excluded from the underlying layer, as determinable by printing a uniform test area on the recording element with said pigment-based ink to an optical density between 1.0 and 2.5 and then fusing the printed element, resulting in greater than 50% of the pigment colorant in the pigment-based ink being retained in the bottom half of the upper fused layer, as determined by optical micro-densitometry on a cross-section of the test area of the printed and fused recording element.

By use of the invention, an inkjet recording element can be obtained that has good smudge resistance immediately after printing and that, when subsequently fused, exhibits good abrasion resistance, water resistance and high-print density.

The pigment-based ink can be any one of the of the ink compositions used in the printer, preferably all of the black or colored ink compositions, typically including yellow, cyan, and magenta.

In a preferred embodiment, the volume of pigment particles printed in an area of maximum image density should be less than the void volume of the porous upper fusible layer, and the volume of ink fluid printed in an area of maximum image density should not exceed the void volume of the porous ink-fluid-receiving layer.

The present method allows for stratification of the pigmented image at the bottom portion of the upper fusible layer, since while the capacity of the ink-fluid receiving layer and the pore-size hierarchy of the layers assures that most of the ink fluid will be drawn into the lower porous layer, the pigment particles after passing through the pores of the uppermost layer are retained at or nearer the interface with the lower layer. As the volume of ink pigment is less than the void volume of the uppermost fusible layer, the pigment will be stratified at or near the bottom of the upper fusible layer with little or no pigment at the surface of the print. This provides an immediate benefit in reducing the smudging, or smearing, of the unfused image due to any accidental contact with the printed pigment on the surface of the media prior to fusing. Subsequent fusing of the uppermost layer gives a protected sub-surface pigmented image. Among the advantage of the present fused inkjet recording element having a sub-surface pigmented image are: abrasion resistance, uniform gloss, absence of color gloss/bronzing, and water and stain resistance.

Another aspect of the invention relates to a print made by the above method, wherein the print comprises a support and, in order upon the support, a lower porous layer and a fused upper layer comprising a continuous polymeric film comprising an image formed by said pigment-based ink.

In one embodiment of the invention, the recording medium used in the present method comprises a porous support and a porous upper fusible layer. In this embodiment, the support also functions as an adjacent underlying porous ink-fluid-receiving layer. In yet other embodiments, a porous ink-fluid-receiving layer in addition to a porous support can be present, or a plurality of ink-fluid-receiving layers in combination with a porous or non-porous support can be present.

The term "porous layer" is used herein to define a layer that absorbs applied ink by means of capillary action rather than liquid diffusion. (Similarly, the term porous element refers to an element having at least one porous layer, at least the image-receiving layer.) Porosity can be affected by the particle geometry, and the particle to binder ratio. The porosity of a mixture may be predicted based on the critical pigment volume concentration (CPVC).

The term "size" with respect to particle size and pore size is defined according to the measurements described in the examples or their equivalent.

By the term "determinable," with respect to a specified test, is meant that the specified test can be used to determine or verify if a combination of an inkjet recording element and a ink composition used in the claimed printing method is within the claim scope, but that the specified test is not part of the claimed method for printing images. In other words, practicing the method with the specified combination is sufficient to infringe the claimed method, irrespective of performing the specified test.

As used herein, the terms "over," "upper," "under," "below," "lower," and the like, with respect to layers in the inkjet media, refer to the order of the layers over the support, but do not necessarily indicate that the layers are immediately adjacent.

In regard to the present method, the term "image-receiving layer" is intended to define a layer that is used as a pigment-trapping layer, dye-trapping layer, or dye-and-pigment-trapping layer.

In regard to the present method, the term "ink-fluid-receiving layer" (sometimes also referred to as a "sump layer," "ink-carrier-liquid receptive layer" or the like) is used herein to define a layer under the one or more image-receiving layers that absorbs a substantial amount of ink-carrier liquid. In use, a substantial amount, preferably most, of the carrier fluid for the ink is received in the ink-carrier-liquid layer or layers, but wherein the layer is not above an image-containing layer and is not itself an image-containing layer (a pigment-trapping layer or dye-trapping layer). Preferably, there is a single ink-fluid-receiving layer.

The term "thermoplastic polymer" is used herein to define a polymer that flows upon application of heat, or heat and pressure, typically prior to any extensive crosslinking.

DETAILED DESCRIPTION OF THE INVENTION

Figure 1:
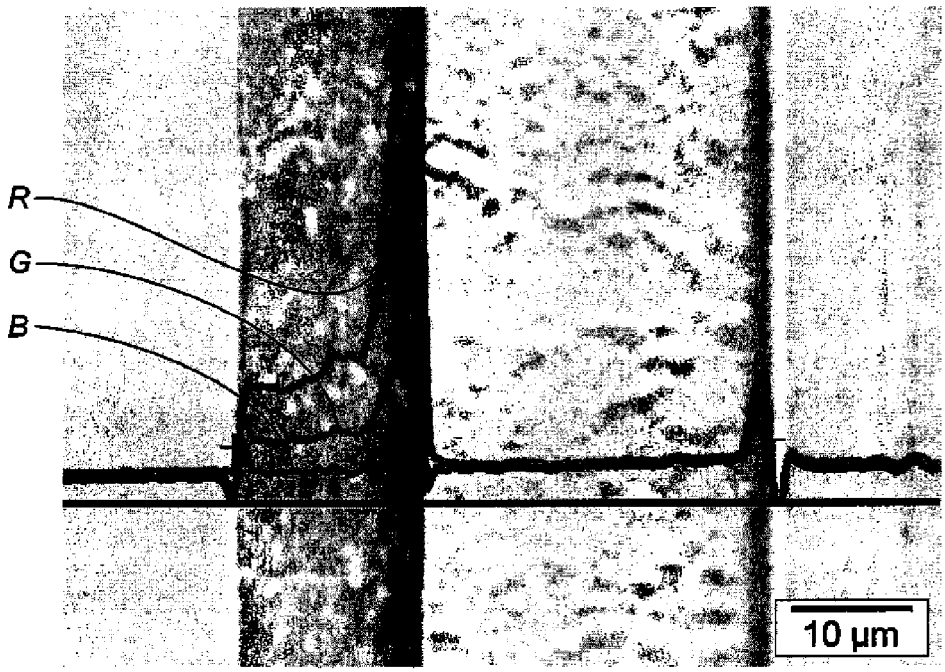
FIG. 1 is a photomicrograph of a cross-section of a printed fused inkjet recording medium prepared in accordance with the method of the present invention.

The porous layers of the element used in the method have relevant functionality with regard to both ink-fluid-transport and ink-pigment filtration. With regard to the former, the porous upper fusible, preferably the uppermost or top layer, has a median pore size larger than the ink-fluid-receiving layer, i.e., the adjacent underlying or lower layer. This pore-size hierarchy establishes a capillary pressure in the printed areas that drives the ink fluid from the upper into the underlying layer. With regard to ink pigment filtration, the median pore size of the upper layer must be larger than the mean particle size of the ink pigment, which allows the ink-pigment particles to move with the ink fluid within the pore structure of the upper fusible layer. Concomitantly, the median pore size of the lower layer must be smaller than the ink pigment mean particle size, so that pigment particles cannot not substantially enter the pore structure of the lower layer. As capillary pressure drives the ink fluid into the lower layer, the ink-pigment particles are, in effect, filtered at or near the interface between the upper and lower layers.

A preferred embodiment of the present method is directed to inkjet printing a color image on an inkjet recording element, which method comprises:

a) providing an inkjet printer that is responsive to digital data signals;

b) loading the printer with a fusible inkjet recording element having a support and thereon, in order from the support, a porous ink-fluid-receiving layer and a porous upper fusible layer adjacent and overlying the ink-fluid-receiving layer, and c) loading the printer with a plurality of inkjet ink compositions including at least a cyan, yellow, and magenta ink composition, wherein at least one, preferably all three of the ink compositions comprise pigment colorant particles pigment whose mean pigment particle size is smaller than about 80 percent, preferably smaller than 70 percent, of the median pore size of the upper fusible layer, but larger than 80 percent of the median pore size of the adjacent underlying ink-fluid-receiving layer, wherein the thickness of the porous fusible layer is from 1 to 50 micrometers, preferably 10 to 30 micrometers, d) printing on the fusible inkjet recording element using the inkjet ink composition in response to the digital data signals; and e) fusing the printed element to obtain a fused upper layer;

as determinable by printing a uniform test area with at least one, preferably all three, of said pigment-based ink compositions to an optical density of between 1.0 and 2.5 and then fusing the printed element, resulting in greater than 50%, preferably greater than 60 percent, of the pigment colorant in the pigment-based ink is retained in the bottom half of the fused upper layer, as determined by optical micro-densitometry on a cross-section of the test area of the fused printed element, in accordance with the measurement described in the examples below.

The ink compositions mentioned above are for use in a colored printer and comprise at least cyan, yellow, and magenta-colored ink compositions. Other ink compositions can optionally achieve the ink-pigment stratification of the present invention, including black ink compositions and other colored ink compositions. Conventional inkjet printers now commonly have 4 to 8 different colored inks in addition to black, especially for photographic quality inkjet printers.

Preferably, the mean particle size of the pigment in the pigment-based ink is at most 70 percent of, and preferably from 70 to 1 percent, of the median pore size of the upper fusible layer. Preferably, the mean particle size of the pigment is larger than the median pore size (at least 100%) of the underlying layer.

The mean particle size of the ink pigment can be experimentally determined as described in the examples. The mean particle size is measured on a uniform mixture as specified by the manufacturer of the apparatus used in the test. The particle size distribution of ink pigments can vary and it is usually desirable that the distribution is relatively narrow such that there is not an excessive amount of the relatively smaller particles in the ink composition that can migrate into the underlying layer. Similarly, an excessive amount of relatively large particles in the mixture may be undesirable if the free flow of ink particles in the upper fusible layer prevents migration to the necessary amount of ink particles to the lower portion the upper fusible layer.

Although the invention is defined in terms of retaining greater than 50% of the printed pigment colorant, of the inkjet ink composition, in the bottom half of the upper fused layer, this reflects the fact the interface of the upper and lower adjacent porous layers performs a filtration function with respect to the pigment particles. It is especially desirable that an upper portion of the upper fused layer has a limited or maximum concentration of colorant therein. Accordingly, defining the invention in terms of having less than 50% of the printed pigment colorant in the upper half of the layer includes the possibility (depending on particular embodiments) of having lesser amounts of printed pigment in lesser portions of the upper fused layer which portions extend from the top surface up to the midpoint of the upper fused layer. For example, the invention includes the possibility of retaining less than 20% of the ink pigment within the upper 20% (within 1 micrometer) of a 5-micrometer upper fused layer.

In the preferred embodiment, the percent pigment retained in the upper N percent of the fused layer is less than N percent of the total printed pigment, wherein N percent runs from about 100% to about 10%. Accordingly, when N is equal to 50, then within the upper 50% of the fused layer there is less than 50% of the printed pigment, and when N is equal 10, within the upper 10% there is less than 10%, etc. Such a profile of ink colorant, in cross-section, is illustrated in FIG. 1.

In one particular embodiment of an inkjet recording element comprising a support, and coated thereon in order from the support, a porous ink-fluid-receiving layer and a porous upper fusible layer adjacent and overlying the ink-fluid-receiving layer, wherein the median pore size of the upper fusible layer is at least four times greater than the median pore size of the adjacent underlying ink-fluid-receiving layer, wherein the median pore size of the upper fusible layer is within the range of the 80 to 2000 nm, wherein the thickness of the porous fusible layer is from 1 to 50 micrometers, preferably 10 to 30 micrometers, wherein the median pore size of the upper fusible layer is preferably 200 to 400 nm, and the lower less than 50 nm.

Fusible, polymeric particles employed in the upper fusible layer of the inkjet recording elements of invention may have any particle size provided they will form a porous layer whose median pore size is greater than the median pore size of the lower layer and at least 30% greater than the mean pigment particle size, preferably 30 to 300% greater. In a preferred embodiment of the invention, the mean particle size of the fusible, polymeric particle may range from about 0.10 to about 10 μm, preferably 200 nm to 5.0 μm, preferably 300 nm to 3 μg/m, and the median pore size in the upper fusible layer may vary from 80 to 2000 nm, more preferably 90 to 400 nm, most preferably 100 to 350 nm.

In a preferred embodiment of the invention, the fusible polymer particles are substantially spherical and monodisperse. Monodisperse particles may be advantageous for controlling fluid absorption and can be used to improve dry time. On the other hand, monodispersed particles may be more difficult to make.

The UPA dispersity ("Dp"), which is a measure of the breadth of the particle size distribution, is preferably less than 2.0, as measured by a Microtrac® Ultra Fine Particle Analyzer Model 150 (Leeds and Northrup) at a 50% mean value. This is another way of saying that the particle size distribution is relatively narrow. Upon fusing of the fusible, polymeric particles, the air-particle interfaces present in the original porous structure of the upper fusible layer are eliminated, and a non-scattering, substantially continuous layer forms. Given the aforementioned relative median pore and pigment sizes, and allowing that the volume of printed pigment doesn't exceed the void volume of the layer, more than half of the printed pigment will be located in the bottom half of the fused layer. The upper half of the fused layer then serves as a non-scattering protective overcoat, which protects the bulk of the image from abrasions and affords high optical densities.

The fusible, polymeric particles comprising the upper fusible layer may be formed from a condensation polymer, an acrylic polymer, a styrenic polymer, a vinyl polymer, an ethylene-vinyl chloride copolymer, a polyacrylate, poly(vinyl acetate), poly(vinylidene chloride), a vinyl acetate-vinyl chloride copolymer. In a preferred embodiment of the invention, the fusible, polymeric particles comprise an acrylic polymer, a cellulose acetate ester, or a polyurethane polymer. In one particularly preferred embodiment of the invention, the fusible, polymeric particles comprise a copolymer of 86 parts by weight of ethyl methacrylate and 14 parts by weight of methyl methacrylate, Tg=85° C.

The upper fusible layer of fusible, polymeric particles may optionally additionally comprise a binder, preferably a hydrophobic binder. Hydrophobic binders useful in the invention can be any hydrophobic polymers capable of being dispersed in water. In a preferred embodiment of the invention, the hydrophobic binder is an aqueous dispersion of an acrylic polymer or a polyurethane polymer.

The particle-to-binder ratio of the particles and binder employed in the upper, fusible layer can range between about 98:2 and 60:40, preferably between about 95:5 and about 80:20. In general, a layer having particle-to-binder ratios above the range stated may not have sufficient cohesive strength; and a layer having particle-to-binder ratios below the range stated may not be sufficiently porous to provide good image quality. In the absence of a binder, sintering or the like may be used to promote cohesive strength.

The upper fusible layer is usually present in an amount from about 1 $g/m^2$ to about 50 $g/m^2$. In a preferred embodiment, the upper fusible layer is present in an amount from about 8 $g/m^2$ to about 30 $g/m^2$.

The porous ink-fluid-receiving layer is a continuous, coextensive porous layer that contains organic or inorganic particles. Examples of organic particles which may be used include core/shell particles such as those disclosed in U.S. Pat. No. 6,492,006 to Kapusniak et al., and homogeneous particles such as those disclosed in U.S. Pat. No. 6,475,602 to Kapusniak et al., the disclosures of which are hereby incorporated by reference. Examples of organic particles that may be used include acrylic resins, styrenic resins, cellulose derivatives, polyvinyl resins, ethylene-allyl copolymers and polycondensation polymers such as polyesters.

Examples of inorganic particles that may be used in the ink-fluid receptive layer employed in the invention include silica, alumina, titanium dioxide, clay, calcium carbonate, barium sulfate, or zinc oxide.

In a preferred embodiment of the invention, the porous ink-fluid-receiving layer comprises from about 20% to about 100% of particles and from about 0% to about 80% of a polymeric binder, preferably from about 80% to about 95% of particles and from about 20% to about 5% of a polymeric binder. The polymeric binder may be a hydrophilic polymer such as poly(vinyl alcohol), poly(vinyl pyrrolidone), gelatin, cellulose ethers, poly(oxazolines), poly(vinylacetamides) partially hydrolyzed poly(vinyl acetate/vinyl alcohol), poly (acrylic acid), poly(acrylamide), poly(alkylene oxide) sulfonated or phosphated polyesters, dextran, collagen derivatives. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

In order to impart mechanical durability to an inkjet recording element, crosslinkers that act upon the binder in the ink-fluid-receiving layer discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid derivatives, and the like may be used. Preferably, the crosslinker is an aldehyde, an acetal or a ketal, such as 2,3-dihydroxy-1,4-dioxane.

The ink-fluid receiving layer may be present in an amount from about 10 g/m$^2$ to about 60 g/m$^2$, preferably from about 20 g/m$^2$ to about 50 g/m$^2$.

The porous ink-fluid-receiving layer can also comprise an open-pore polyolefin, open-pore polyester, or an open-pore membrane. An open-pore membrane can be formed in accordance with the known technique of phase inversion. Examples of a porous ink-receiving layers comprising an open-pore membrane are disclosed in U.S. Pat. Nos. 6,497,941 and 6,503,607, both of Landry-Coltrain et al., hereby incorporated by reference.

It may be optionally desirable for the above-described fusible inkjet recording element to also be useful for recording dye inks. Optionally then a dye mordant may be employed in the upper fusible layer. The dye mordant can be any material that is substantive to inkjet dyes. The dye mordant can fix dyes within the porous upper fusible layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium) propyl chloride. In a preferred embodiment, the cationic mordant is a quaternary ammonium compound.

In order to be compatible with the mordant, both the binder and the polymer comprising the fusible, polymeric particles should be either uncharged or the same charge as the mordant. However, colloidal instability and unwanted aggregation during coating should be avoided if the polymer particles or the binder has a charge opposite from that of the mordant.

The thickness of the underlying ink-fluid-receiving layer will depend on whether there are additional ink-fluid-receiving layers and/or an underlying support that is porous and capable of absorbing or contributing to the absorption of the liquid carrier. Preferably, the total absorbent capacity of (i) the ink receptive layer alone or (ii) if porous, the support alone or (iii) the combination of the ink receptive layer and, if porous, the support is, in each case, preferably at least about 10 cc/m$^2$, although the desired absorbent capacity is related to the amount of fluid applied which amount may vary depending on the printer and the ink composition employed. By a total absorbent capability of at least 10.0 cc/m$^2$ is meant that the capacity is such as to enable at least 10.0 cc of ink to be absorbed per 1 m$^2$. This is a calculated number, based on the thickness of the layer or layers. In the case of voided layers, the desired thickness can be determined by using the formula $t=10.0/v$ where v is the void volume fraction defined as the ratio of voided thickness minus unvoided thickness to the voided thickness. The actual thickness of an extruded monolayer can be easily measured. For a co-extruded layer, photomicroscopy of a cross-section can be used to determine the actual thickness. The unvoided thickness is defined as the thickness that would be expected had no voiding occurred, for example, the cast thickness divided by the stretch ratio in the machine direction and the stretch ratio in the cross direction.

The support used in the inkjet recording element of the invention may be opaque, translucent, or transparent. Typically, the support is a self-standing material for providing structural rigidity. In the preferred embodiment, the other layers of the inkjet recording element, including the ink-receptive layer and the ink-transporting layer are coated on the support. The support may itself be porous or non-porous. There may be used, for example, porous supports such as, plain papers, open-pore polyolefins, open-pore polyesters or an open pore membrane.

In one embodiment of the present invention a porous polyester support such as disclosed in U.S. Pat. No. 6,379,780 to Laney et al. and U.S. Pat. No. 6,489,008, the disclosures of both of which are hereby incorporated by reference, can be used. This polyester support comprises a base polyester layer and an ink-liquid-carrier permeable upper polyester layer, the upper polyester layer comprising a continuous polyester phase having a total absorbent capacity of at least about 14 cc/m$^2$ but which absorbent capacity can be adjusted as desired for use in the present invention.

In still another embodiment, a porous support can comprise poly(lactic acid), for example, as disclosed in copending commonly assigned U.S. Ser. No. 10/722,886 (docket 86688), hereby incorporated by reference in its entirety. In this embodiment, a microvoided polylactic-acid-containing layer can have levels of voiding, thickness, and smoothness adjusted to provide desired absorbency or other properties. The polylactic acid-containing layer can advantageously also provide stiffness to the media and physical integrity to other layers. The thickness of the microvoided polylactic acid layer can be 30 to 400 μm depending on the required stiffness of the recording element. Typically, a thickness of at least about 28.0 μm is needed to achieve a total absorbency of 10 cc/m$^2$ if desired for use as a carrier liquid retaining layer.

If a porous support is employed it may be advantageous for the support to have a median pore size smaller than that of the ink-fluid-receiving layer. For example, a permeable microvoided or otherwise porous support contains voids that are interconnected or open-celled in structure can enhance the liquid carrier absorption rate by enabling capillary action to occur. Maintaining the correct pore size hierarchy can afford access to the pore capacity of the support and eliminate capacity-related bleed.

Non-porous supports can be for example, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, and the like. The thickness of the support employed in the invention can be from about 12 to about 500 μm, preferably from about 75 to about 300 μm.

If desired, in order to improve the adhesion to the support of the first coated layer, which may be the ink-fluid-receiving layer or an intermediate layer (which can be referred to as a base layer if not an ink-fluid-receiving layer), the surface of the support may optionally be corona-discharge-treated prior to applying the base layer or ink-fluid receptive layer to the support.

In a preferred embodiment of the invention, at least 75 weight percent of the ink carrier liquid that is applied to the receiver is retained, before drying, by the one or more ink-fluid-receiving layers or a porous support or a combination of both.

As indicated above, another aspect of the invention relates to a print made by the above method, wherein the print comprises a support and, in order upon the support, a lower porous layer and a fused upper layer comprising a continuous polymeric film comprising an image formed by said pigment-based ink.

In one preferred embodiment, the print is made using a fusible inkjet recording element comprising a support, and coated thereon in order from the support, a porous ink-fluid-receiving layer and a porous upper fusible layer adjacent and overlying the ink-fluid-receiving layer, wherein the median pore size of the upper fusible layer is preferably at least 50% greater, preferably at least 100% greater, more preferably at least 300% greater, than the median pore size of the adjacent underlying ink-fluid-receiving layer, wherein the median pore size of the underlying layer is less than 50 nm, preferably not more than 40 nm, and wherein the thickness of the porous fusible layer is from 1 to 50 micrometers, preferably 10 to 30 micrometers. In one preferred embodiment, the median pore size of the upper fusible layer is 200 to 400 nm.

Since the inkjet recording element used in the present invention may come in contact with other image recording articles or the drive or transport mechanisms of image recording devices, additives such as surfactants, lubricants, matte particles and the like may be added to the element to the extent that they do not degrade the properties of interest.

The layers described above, including the ink-fluid-receiving layer, and the upper fusible layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of multiple layers, which is preferred from a manufacturing economic perspective.

After printing on the element according to the invention, the upper fusible layer is heat and/or pressure fused to form a substantially continuous layer on the surface. Upon fusing, the layer is rendered non-light scattering, which importantly provides for maximum density in the printed images. Fusing may be accomplished in any manner that is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference.

In a preferred embodiment, fusing is accomplished by contacting the surface of the element with a heat-fusing member, such as a fusing roller or fusing belt. Thus, for example, fusing can be accomplished by passing the element through a belt fusing apparatus, heated to a temperature of about 60° C. to about 160° C., using a pressure of 0.05 to about 2.0 MPa at a transport rate of about 0.005 m/sec to about 0.5 m/sec.

The inkjet printing method of the present invention represents a non-impact method for producing printed images by means of the deposition of ink droplets in a pixel-by-pixel manner to the inkjet recording element in response to digital data signals. There are various methods that may be utilized in the present method to control the deposition of the ink droplets on the inkjet recording element to yield the desired printed image. In one embodiment, in a process known as drop-on-demand inkjet, individual ink droplets are projected as needed onto the image-recording element to form the desired printed image. Common methods of controlling the projection of ink droplets in drop-on-demand printing include piezoelectric transducers and thermal bubble formation. In another embodiment, in a process known as continuous inkjet, a continuous stream of ink droplets is charged and deflected in an image-wise manner onto the surface of the inkjet recording element, while unimaged droplets are caught and returned to an ink sump. Such printing methods are broadly applicable across markets ranging from desktop document and photographic-quality imaging, to short run printing and industrial labeling.

Ink compositions known in the art of inkjet printing are useful in the present method and may be aqueous- or solvent-based, and in a liquid, solid or gel state at room temperature and pressure. Aqueous-based ink compositions are preferred because they are more environmentally friendly as compared to solvent-based inks, plus most print heads are designed for use with aqueous-based inks.

The present method employs at least one pigment-based ink composition that substantially comprises pigment colorant particles. However, a pigment-based ink composition may comprise other colorants in minor amounts (preferably in an amount less than 20 percent by weight solids of total colorant). Also, a pigment-based ink composition of one color may be used, in the present inkjet printing method, in combination with one or more ink compositions, of a different color, that are not pigment-based ink compositions, for example, dye-based ink compositions that may be colored with dyes, polymeric dyes, loaded-dye/latex particles, etc., or combinations thereof. However, preferably not more than one of the ink compositions used in the present invention are not pigment-based ink compositions and, more preferably, all of the ink compositions used in the present method are pigment-based ink compositions.

Pigment-based ink compositions are advantageously used in the present invention because such inks render printed images tending to have higher optical densities and better resistance to light and ozone as compared to printed images made from other types of colorants. The ink compositions may be yellow, magenta, cyan, black, gray, red, violet, blue, green, orange, brown, etc.

A wide variety of organic and inorganic pigments, alone or in combination with additional pigments or dyes, may be used in the ink compositions useful in the present invention. Pigments that may be used include those disclosed in, for example, U.S. Pat. Nos. 5,026,427; 5,086,698; 5,141,556;

5,160,370; and 5,169,436. The exact choice of pigments will depend upon the specific application and performance requirements such as color reproduction and image stability.

Pigments suitable for use in the invention include, but are not limited to, azo pigments, monoazo pigments, disazo pigments, azo pigment lakes, β-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black.

Typical examples of pigments that may be used include Color Index (C. I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C. I. Pigment Red 1, 2, 3, 4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66, bridged aluminum phthalocyanine pigments; C.I. Pigment Black 1, 7, 20, 31, 32; C. I. Pigment Orange 1, 2, 5, 6, 13, 15, 16, 17, 17:1, 19, 22, 24, 31, 34, 36, 38, 40, 43, 44, 46, 48, 49, 51, 59, 60, 61, 62, 64, 65, 66, 67, 68, 69; C.I. Pigment Green 1, 2, 4, 7, 8, 10, 36, 45; C.I. Pigment Violet 1, 2, 3, 5:1, 13, 19, 23, 25, 27, 29, 31, 32, 37, 39, 42, 44, 50; or C.I. Pigment Brown 1, 5, 22, 23, 25, 38, 41, 42.

Pigment-based ink compositions useful in the invention may be prepared by any method known in the art of ink jet printing. Useful methods commonly involve two steps: (a) a dispersing or milling step to break up the pigments to primary particles, where primary particle is defined as the smallest identifiable subdivision in a particulate system, and (b) a dilution step in which the pigment dispersion from step (a) is diluted with the remaining ink components to give a working strength ink. A milling step (a) can be carried out using any type of grinding mill such as a media mill, a ball mill, a two-roll mill, a three-roll mill, a bead mill, and air-jet mill, an attritor, or a liquid interaction chamber. In the milling step (a), pigments are optionally suspended in a medium which is typically the same as or similar to the medium used to dilute the pigment dispersion in step (b). Inert milling media are optionally present in the milling step (a) in order to facilitate break up of the pigments to primary particles. Inert milling media include such materials as polymeric beads, glasses, ceramics, metals and plastics as described, for example, in U.S. Pat. Nos. 5,891,231 and 5,679,138. Milling media are removed from either the pigment dispersion obtained in step (a) or from the ink composition obtained in step (b).

A dispersant is optionally present in the milling step (a) in order to facilitate break up of the pigments into primary particles. For the pigment dispersion obtained in step (a) or the ink composition obtained in step (b), a dispersant is optionally present in order to maintain particle stability and prevent settling. Dispersants suitable for use in the invention include, but are not limited to, those commonly used in the art of ink jet printing. For aqueous pigment-based ink compositions, useful dispersants include anionic, cationic or nonionic surfactants such as sodium dodecylsulfate, or potassium or sodium oleylmethyltaurate as described in, for example, U.S. Pat. Nos. 5,679,138; 5,651,813, and 5,985,017, or US2004/0097615 A1.

Polymeric dispersants are also known and useful in aqueous pigment-based ink compositions. Polymeric dispersants may be added to the pigment dispersion prior to, or during the milling step (a), and include polymers such as homopolymers and copolymers; anionic, cationic or nonionic polymers; or random, block, branched or graft polymers. Polymeric dispersants useful in the milling operation include random and block copolymers having hydrophilic and hydrophobic portions; see for example, U.S. Pat. Nos. 4,597,794; 5,085,698; 5,519,085; 5,272,201; 5,172,133; and 6,043,297; and graft copolymers; see for example, U.S. Pat. Nos. 5,231,131; 6,087,416; 5,719,204; and 5,714,538.

Composite colorant particles having a colorant phase and a polymer phase can also be used in aqueous pigment-based inks. Composite colorant particles are formed by polymerizing monomers in the presence of pigments; see for example, U.S. Ser. Nos. 10/446,013; 10/446,059; or 10/665,960. Microencapsulated-type pigment particles are also useful and consist of pigment particles coated with a resin film; see for example U.S. Pat. No. 6,074,467.

Aqueous pigment-based ink compositions useful in the method of the present invention may also contain self-dispersed colorants in which the surfaces of pigment particles are chemically functionalized such that a separate dispersant is not necessary; see for example, U.S. Pat. No. 6,494,943 B1 and U.S. Pat. No. 5,837,045.

Also useful in the printing method of the invention are polymeric dyes or loaded-dye/latex particles. Examples of polymeric dyes are described in U.S. Pat. No. 6,457,822 Bland references therein. Examples of loaded-dye/latex particles are described in U.S. Pat. No. 6,431,700 B1 and U.S. application Ser. Nos. 10/393,235; 10/393,061; 10/264,740; 10/020,694; and 10/017,729.

The colorants used in the ink composition used in the present method may be present in any effective amount, generally from 0.1 to 10% by weight, and preferably from 0.5 to 6% by weight. Ink jet ink compositions may also contain non-colored particles such as inorganic particles or polymeric particles. The use of such particulate addenda has increased over the past several years, especially in ink jet ink compositions intended for photographic-quality imaging. For example, U.S. Pat. No. 5,925,178 describes the use of inorganic particles in pigment-based inks in order to improve optical density and rub resistance of the pigment particles on the image-recording element. In another example, U.S. Pat. No. 6,508,548 B2 describes the use of water-dispersible polymeric latex in dye-based inks in order to improve light and ozone resistance of the printed images.

Ink compositions useful in the present method may contain non-colored particles such as inorganic or polymeric particles in order to improve gloss differential, light and/or ozone resistance, waterfastness, rub resistance and various other properties of a printed image; see for example, U.S. Pat. No. 6,598,967 B1 or U.S. Pat. No. 6,508,548 B2.

For aqueous-based inks, polymeric particles useful in the invention include water-dispersible polymers generally classified as either addition polymers or condensation polymers, both of which are well-known to those skilled in the art of polymer chemistry. Examples of polymer classes include acrylics, styrenics, polyethylenes, polypropylenes, polyesters, polyamides, polyurethanes, polyureas, polyethers, polycarbonates, polyacid anhydrides, and copolymers consisting of combinations thereof. Such polymer particles can be ionomeric, film-forming, non-film-forming, fusible, or heavily cross-linked and can have a wide range of molecular weights and glass transition temperatures.

Examples of useful polymeric particles are styrene-acrylic copolymers sold under the trade names Joncryl® (S.C. Johnson Co.), Ucar™ (Dow Chemical Co.), Jonrez® (MeadWestvaco Corp.), and Vancryl® (Air Products and Chemicals, Inc.); sulfonated polyesters sold under the trade name Eastman AQ® (Eastman Chemical Co.); polyethylene or polypropylene resin emulsions and polyurethanes (such as the Witcobonds® from Witco). These polymeric particles are preferred because they are compatible in typical aqueous-based ink compositions, and because they render printed images that are highly durable towards physical abrasion, light and ozone.

The non-colored particles used in the ink composition may be present in any effective amount, generally from 0.01 to 20% by weight, and preferably from 0.01 to 6% by weight. The exact choice of non-colored particles will depend upon the specific application and performance requirements of the printed image.

Ink compositions may also contain water-soluble polymers often referred to as resins or binders in the art of inkjet ink compositions. The water-soluble polymers useful in the ink composition are differentiated from polymer particles in that they are soluble in the water phase or combined water/water-soluble solvent phase of the ink. Included in this class of polymers are nonionic, anionic, amphoteric and cationic polymers. Representative examples of water soluble polymers include, polyvinyl alcohols, polyvinyl acetates, polyvinyl pyrrolidones, carboxy methyl cellulose, polyethyloxazolines, polyethyleneimines, polyamides and alkali soluble resins; polyurethanes (such as those found in U.S. Pat. No. 6,268,101), polyacrylic acids, styrene-acrylic methacrylic acid copolymers (such as; as Joncryl® 70 from S.C. Johnson Co., TruDot™ IJ-4655 from MeadWestvaco Corp., and Vancryl® 68S from Air Products and Chemicals, Inc.

Ink compositions useful in the invention include humectants and/or co-solvents in order to prevent the ink composition from drying out or crusting in the nozzles of the printhead, aid solubility of the components in the ink composition, or facilitate penetration of the ink composition into the image-recording element after printing. Representative examples of humectants and co-solvents used in aqueous-based ink compositions include (1) alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; (2) polyhydric alcohols, such as ethylene glycol, diethylene glycol, triethylene glycol, tetraethylene glycol, propylene glycol, polyethylene glycol, polypropylene glycol, 1,2-propane diol, 1,3-propane diol, 1,2-butane diol, 1,3-butane diol, 1,4-butane diol, 1,2-pentane diol, 1,5-pentanediol, 1,2-hexanediol, 1,6-hexane diol, 2-methyl-2,4-pentanediol, 1,2-heptane diol, 1,7-hexane diol, 2-ethyl-1,3-hexane diol, 1,2-octane diol, 2,2,4-trimethyl-1,3-pentane diol, 1,8-octane diol, glycerol, 1,2,6-hexanetriol, 2-ethyl-2-hydroxymethyl-propane diol, saccharides and sugar alcohols and thioglycol; (3) lower mono- and di-alkyl ethers derived from the polyhydric alcohols; such as, ethylene glycol monomethyl ether, ethylene glycol monobutyl ether, ethylene glycol monoethyl ether acetate, diethylene glycol monomethyl ether, and diethylene glycol monobutyl ether acetate (4) nitrogen-containing compounds such as urea, 2-pyrrolidone, N-methyl-2-pyrrolidone, and 1,3-dimethyl-2-imidazolidinone; and (5) sulfur-containing compounds such as 2,2'-thiodiethanol, dimethyl sulfoxide and tetramethylene sulfone. Typical aqueous-based ink compositions useful in the invention may contain, for example, the following components based on the total weight of the ink: water 20-95%, humectant(s) 5-70%, and co-solvent(s) 2-20%.

Surfactants may be added to adjust the surface tension of the ink to an appropriate level. The surfactants may be anionic, cationic, amphoteric or nonionic and used at levels of 0.01 to 5% of the ink composition. Examples of suitable nonionic surfactants include, linear or secondary alcohol ethoxylates (such as the Tergitol® 15-S and Tergitol® TMN series available from Union Carbide and the Brij® series from Uniquema), ethoxylated alkyl phenols (such as the Triton® series from Union Carbide), fluoro surfactants (such as the Zonyls® from DuPont; and the Fluorads® from 3M), fatty acid ethoxylates, fatty amide ethoxylates, ethoxylated and propoxylated block copolymers (such as the Pluronic® and Tetronic® series from BASF, ethoxylated and propoxylated silicone based surfactants (such as the Silwet® series from CK Witco), alkyl polyglycosides (such as the Glucopons® from Cognis) and acetylenic polyethylene oxide surfactants (such as the Surfynols® from Air Products).

Examples of anionic surfactants include: carboxylated (such as ether carboxylates and sulfosuccinates), sulfated (such as sodium dodecyl sulfate), sulfonated (such as dodecyl benzene sulfonate, alpha olefin sulfonates, alkyl diphenyl oxide disulfonates, fatty acid taurates and alkyl naphthalene sulfonates), phosphated (such as phosphated esters of alkyl and aryl alcohols, including the Strodex® series from Dexter Chemical), phosphonated and amine oxide surfactants and anionic fluorinated surfactants. Examples of amphoteric surfactants include; betaines, sultaines, and aminopropionates. Examples of cationic surfactants include; quaternary ammonium compounds, cationic amine oxides, ethoxylated fatty amines and imidazoline surfactants. Additional examples are of the above surfactants are described in "McCutcheon's Emulsifiers and Detergents: 1995, North American Editor".

A biocide may be added to an inkjet ink composition to suppress the growth of micro-organisms such as molds, fungi, etc. in aqueous inks. A preferred biocide for an ink composition is Proxel® GXL (Zeneca Specialties Co.) at a final concentration of 0.0001-0.5 wt. %. Additional additives which may optionally be present in an ink jet ink composition include thickeners, conductivity enhancing agents, anti-kogation agents, drying agents, waterfast agents, dye solubilizers, chelating agents, binders, light stabilizers, viscosifiers, buffering agents, anti-mold agents, anti-curl agents, stabilizers and defoamers.

The pH of aqueous ink compositions may be adjusted by the addition of organic or inorganic acids or bases. Useful inks may have a preferred pH of from about 2 to 10, depending upon the type of dye or pigment being used. Typical inorganic acids include hydrochloric, phosphoric and sulfuric acids. Typical organic acids include methanesulfonic, acetic and lactic acids. Typical inorganic bases include alkali metal hydroxides and carbonates. Typical organic bases include ammonia, triethanolamine and tetramethylethlenediamine.

The exact choice of ink components will depend upon the specific application and performance requirements of the printhead from which they are jetted. Thermal and piezoelectric drop-on-demand printheads and continuous printheads each require ink compositions with a different set of physical properties in order to achieve reliable and accurate jetting of the ink, as is well known in the art of inkjet printing. Acceptable viscosities are typically no greater than 20 cP, and preferably in the range of about 1.0 to 6.0 cP. Acceptable surface tensions are typically no greater than 60 dynes/cm, and preferably in the range of 28 dynes/cm to 45 dynes/cm.

The following examples further illustrate the invention.

EXAMPLES

Preparation of Porous Ink-Fluid-Receptive Sump Layer, L-1

A coating solution at 30% solids was prepared by combining 778 g of a 34.2% dispersion of cationic colloidal boehmite alumina, Catapal 200®, having a dispersed mean particle size of 140 nm, CONDEA Vista Co., 162 g of a 16.7% solution of poly(vinyl alcohol) GH-17®, Nippon Gohsei, Nippon Synthetic Chemical Industry Co., Ltd Co., 6.0 g of dihydroxydioxane crosslinking agent, 9.0 g of Olin® 10G surfactant and the requisite quantity of deionized water. The coating solution was hopper coated at a solids laydown of 32.0 g/m$^2$ onto a subbed polyester support and force air dried to give a support bearing a porous ink-fluid receptive sump layer, L-1. Mercury intrusion porosimetry (AutoPore® IV model 9500 manufactured by Micromeritics Instruments Incorporated, Norcross, Ga., USA) gave a median pore diameter for the coated layer of 30 nm.

Preparation of Porous Ink-Fluid-Receptive Sump Layer, L-2

A coating solution at 30% solids was prepared comprised of 266 g of colloidal boehmite alumina, Disperal 80®, having a dispersed mean particle size of 400 nm, CONDEA Vista Co., 162 g of a 16.7% solution of poly(vinyl alcohol) GH-17®, Nippon Gohsei, Nippon Synthetic Chemical Industry Co., Ltd Co., 6.0 g of dihydroxydioxane crosslinking agent, 9.0 g of Olin® 10G surfactant and the requisite quantity of deionized water. The coating solution was hopper coated at a solids laydown of 32.0 g/m$^2$ onto a subbed polyester support and force air dried to give a support bearing a porous ink-fluid receptive sump layer, L-2. Mercury intrusion porosimetry (AutoPore® IV model 9500 manufactured by Micromeritics Instruments Incorporated, Norcross, Ga., USA) gave a median pore diameter of 174 nm.

Synthesis of Fusible Polymeric Particles P-1 and P-2 For Upper Fusible Layer

A 12-liter, Morton® reaction flask was charged with 4 Kg of demineralized water. The flask contents were heated to 80° C. while stirring at 150 rpm under a nitrogen atmosphere. The initiator solution addition flask was made up with 1974 g of demineralized water and 26.4 g of 2,2'-azobis(2-methylpropionamidine)dihydrochloride. A monomer phase addition flask was prepared by adding 2182 g of ethyl methacrylate, and 364 g of methyl methacrylate. Then, charges to the reaction flask from each addition flask were started at 5 g per minute. The addition flasks were recharged as needed. Samples were taken at various times and the monomer phase feed was stopped when the desired median latex particle size was reached. Each particle made, P-1 and P-2 was a separate reaction run. The charges of the redox-initiator solutions were extended for 30 minutes beyond the end of the monomer phase addition to react with residual monomers. The reaction flask contents were stirred at 80° C. for one hour followed by cooling to 20° C., and filtration through 200 μM polycloth material. The latex was concentrated by ultrafiltration to obtain a 50.7% solids dispersion of cationically charged surfactant-free poly(ethylmethacrylate-co-methylmethacrylate) particles: P-1 (445 nm), and P-2 (1200 nm), as determined using a Horiba® LA-920 Particle Size Analyzer, with a Tg=85° C.

Preparation of Coating Solutions, S-1 and S-2, Containing the Fusible, Polymeric Particles Coating solutions at 40% solids were prepared by combining 275 g of each of the 50.7% solids dispersions of the poly(ethylmethacrylate-co-methylmethacrylate) fusible, polymeric particles prepared above, with 55 g of a hydrophobic binder Witcobond ®W320 (Uniroyal Chemical Co.) a 35% by weight aqueous dispersion of 1.9 μm polyurethane particles Tg=−12° C., and 16 g of a 10% solution of Olin® 10G surfactant and the requisite amount of water. Coating solution S-1 used fusible polymeric particles P-1, and S-2 particles P-2.

Each coating solution was first hopper coated at a solids laydown of 32.0 g/m$^2$ onto a subbed polyester support and force air dried to give a support bearing single porous layers of fusible polymeric particles. Mercury intrusion porosimetry (AutoPore® IV model 9500 manufactured by Micromeritics Instruments Incorporated, Norcross, Ga., USA) gave the following median pore sizes: S-1 (P-1) 110 nm, and S-2 (P-2) 320 nm.

Coating solutions S-1 and S-2 were then hopper coated at a solids laydown of 12.9 g/m$^2$ onto coated sump layers, L-1 and L-2, affording fusible overcoat layers, L-3 and L-4, and force air dried to give inkjet receivers, R1 through R4 as described in Table 1 below, having a polyester support, a porous ink-fluid-receiving layer on the support and a porous, fusible upper layer.

Mercury intrusion porosimetry on the two layer coatings gave pore sizes that corresponded to the above single layer determined pore sizes.

Cyan Pigment Ink Dispersions

A mixture of 325 g of polymeric beads having a mean diameter of 50 μm, 30.0 g of Pigment Blue 15:3 (Sun Chemical Corp.); 10.5 g of potassium oleoyl methyl taurate (KOMT) and 209.5 g of deionized water was prepared. These components were milled in a double walled vessel at room temperature using a high-energy media mill manufactured by Morehouse-Cowles Hochmeyer. The milling time was varied to give a 47 nm mean, and 128 nm mean pigment particle size dispersions as determined using a Microtrac® II Ultrafine Particle Analyzer (UPA) manufactured by Leeds & Northrup. The mixtures were filtered through a 4-8 μm Buchner funnel to remove the polymeric beads, and the resulting filtrates diluted to give Cyan Pigment Dispersions having a 10.0 wt. % final concentration of pigment.

Cyan Pigment Inks

Cyan pigment ink #1 was prepared using the 47 nm cyan pigment dispersion described above to give 2.48 wt. % of pigment relative to the total weight of the ink. Other components included glycerol at 2.7 wt. %, Dowanol® DB at 2.5 wt. %, diethylene glycol at 6.8 wt. %, Jonrez® 4655 at 1.73 wt. %, and Surfynol® 465 at 0.20 wt %. Cyan pigment ink #2 was similarly prepared using the 128 nm cyan pigment dispersion.

Printing

Print test targets, comprising 2.5 cm by 10 cm rectangles at 100% uniform cyan fill created in Corel Draw 9, were printed, onto receivers R1 through R4, with a Canon i550® printer loaded with cyan pigment inks of known mean particle size; cyan pigment ink #1 (47 nm mean particle size with a standard deviation of 2 nm), and cyan pigment ink #2 (128 nm mean particle size with a standard deviation of 3 nm) to form print examples PR-1 through PR-8 as summarized in Table 1 below.

Fusing

The print examples PR-1 through PR-8 were fused in the heated nip of a belt fusing apparatus at 150° C. and 0.34 MPa against a sol-gel coated polyimide belt at 63.5 cm/min.

Pigment Stratification

We define pigment stratification indices for the printed and fused elements; (1) S.I.-1, the integrated optical density in the upper half of the upper fusible layer divided by the total integrated optical density, and (2) S.I.-2 the integrated optical density in the lower half of the upper fusible layer divided by the total integrated optical density.

Measurement of the Stratification Index (S.I.)

Cross-sections (5 μm thick) of the fused print examples PR-1 through PR-8 were mounted between a glass slide and cover slip in Stephens Scientific Resolve® microscope immersion oil (low viscosity). Images were recorded with a 40× (0.75 NA) objective and transfer lens to form a 1600× 1200 pixel image on a SpotRT® camera such that each pixel was 0.113 μm (~1.5× Nyquist frequency for green). The sample was rotated so the section was aligned with a primary axis of the camera CCD sensor. The CCD sensor responds linearly to light intensity and was calibrated to 100% transmission in an adjacent area of the mounting media. A plot of the mean density in each CCD column is overlaid on the image display to enable the operator to select the layer boundary locations. In FIG. 1, is shown the resulting relative OD traces (R, G, B) and boundary locations (+). Integrated optical density for a cyan image is computed from the red minus blue density at each CCD column and integrated between the spatial boundaries selected by the operator.

For cyan, we take the red color plane as the signal and the blue color plane as the background, subtracting blue from red, setting any negative (margin) values to zero (as noise) and then scaling to 100%.

TABLE 1

| Print Example | Invention Versus Comp. | Element No. | Upper Layer | Lower Layer | Pigment Ink | Median Upper Pore Size (nm) | Median Lower Pore Size (nm) | Mean Pigment Size (nm) | S.I.-1 | S.I.-2 |
|---|---|---|---|---|---|---|---|---|---|---|
| PR-1 | Inv | R1 | L3 | L1 | 1 | 110 | 30 | 47 | 25.2 | 74.8 |
| PR-2 | Comp | R2 | L3 | L2 | 1 | 110 | 174 | 47 | 39.0 | 41.6 |
| PR-3 | Inv | R3 | L4 | L1 | 1 | 320 | 30 | 47 | 15.3 | 80.1 |
| PR-4 | Comp | R4 | L4 | L2 | 1 | 320 | 174 | 47 | 13.9 | 17.9 |
| PR-5 | Comp | R1 | L3 | L1 | 2 | 110 | 30 | 128 | 89.5 | 10.5 |
| PR-6 | Comp | R2 | L3 | L2 | 2 | 110 | 174 | 128 | 81.5 | 18.5 |
| PR-7 | Inv | R3 | L4 | L1 | 2 | 320 | 30 | 128 | 27.4 | 64.7 |
| PR-8 | Comp | R4 | L4 | L2 | 2 | 320 | 174 | 128 | 33.3 | 42.6 |

Smudge Test

The above printed samples PR-1 to PR-8 were tested immediately after printing, prior to fusing, by wiping the unfused printed patches with a Finger Cot® finger latex glove. The ink transferred onto the Finger Cots was evaluated, with no ink transfer being the most desirable, using the following scale: (1) No ink transferred, (2) Light transfer and (3) Heavy transfer.

Scratch Test

The fused printed samples PR-1 to PR-8 were conditioned for 24 hours at 21 C and 50% RH prior to testing. Samples were abraded by sliding a fresh disk of Trizact® A5 abrader film (3M) in a reciprocating motion over the surface of each sample for 50 cycles. A 300 g normal force was used in each case. Samples were then visually rated according to the following scale: (1) No density removal, (2) Moderate density removal, (3) Significant density removal.

Reflection Density

The reflection optical densities of the above printed samples PR-1 to PR-8 were read using an X-rite® white reflection standard as background. The test results are summarized in Table 2 below.

TABLE 2

| Print Example | Smudge | Scratch | Density | |
|---|---|---|---|---|
| PR-1 | 1 | 1 | 1.78 | Inv |
| PR-2 | 2 | 1 | 1.80 | Comp |
| PR-3 | 1 | 1 | 1.72 | Inv |
| PR-4 | 2 | 1 | 1.49 | Comp |
| PR-5 | 3 | 3 | 2.16 | Comp |
| PR-6 | 3 | 3 | 2.18 | Comp |
| PR-7 | 1 | 1 | 1.74 | Inv |
| PR-8 | 1 | 1 | 1.43 | Comp |

The inventive examples exhibited good density, excellent pre-fusing smudge resistance, and post-fusing scratch resistance. The inventive examples correspond to those in which at least half the printed pigment density was found in the bottom half of the fused layer.

Although the invention has been described in detail with reference to certain preferred embodiments for the purpose of illustration, it is to be understood that variations and modifications by those skilled in the art can be made without departing from the spirit and scope of the invention.

The invention claimed is:

1. A method of inkjet printing a color image on an inkjet recording element comprising:

(a) providing an inkjet printer that is responsive to digital data signals;

(b) loading the printer with a fusible inkjet recording element having a support and thereon a porous ink-fluid-receiving layer and a porous upper fusible layer, wherein the porous ink-fluid-receiving layer is an adjacent and underlying layer relative to the porous upper fusible layer, and wherein each layer is characterized by a median pore size, the median pore size of the porous upper fusible layer being greater than the median pore size of the underlying layer;

(c) loading the printer with at least one inkjet pigment-based ink composition characterized by a mean pigment particle size of pigment colorant particles in the pigment-based ink;

(d) printing on the fusible inkjet recording element using the ink composition in response to the digital data signals; and (e) fusing the printed element to obtain a fused upper layer, wherein the median pore sizes of the porous upper fusible layer and the underlying layer and the mean pigment particle size of the pigment colorant particles, in combination, are such that, after the ink composition is applied to the recording element, the median pore size of the porous upper fusible layer is sufficiently large and the median pore size of the underlying layer is sufficiently small that, in the printed image, the pigment colorant particles can be concentrated in the lower half relative to the upper half of the of the thickness of the fused upper layer and substantially excluded from the underlying layer, as determinable by printing a area of uniform density on the recording element with said pigment-based ink to an optical density between 1.0 and 2.5 and then fusing the printed element, resulting in greater than 50% of the pigment colorant particles in the pigment-based ink composition being retained in the bottom half of the fused upper layer, as determined by optical micro-densitometry on a cross-section of the test area of the printed and fused recording element.

2. The method of claim 1 wherein the median pore size of the porous upper fusible layer is sufficiently large to allow, relative to the underlying layer, free flow of pigment colorant particles within the porous upper fusible layer, and such that the median pore size of the underlying layer is sufficiently small such that, as determinable by printing in the uniform test area, less than 20 percent of the pigment colorant particles are in said underlying layer in the test area.

3. The method of claim 1 wherein the mean pigment particle size is smaller than about 80 percent of the median pore size of the upper fusible layer but larger than 80 percent of the median pore size of the adjacent underlying ink-fluid-receiving layer.

4. The method of claim 1 wherein the thickness of the porous fusible layer is from 1 to 50 microns.

5. The method of claim 1 wherein the mean pigment particle size is 1 to 70 percent of the median pore size of the upper fusible layer.

6. The method of claim 1 wherein the mean pigment particle size is 15 to 50 percent of the median pore size of the upper fusible layer and the mean pigment particle size is larger than 100 percent of the median pore size of the adjacent underlying ink-fluid-receiving layer.

7. The method of claim 1 wherein, as determinable by printing the uniform area, less than 15 percent of the pigment colorant particles are retained in the underlying layer in the uniform area.

8. The method of claim 1 wherein porous upper fusible layer comprises fusible, polymeric particle having a mean particle size in the ranges from about 0.10 to about 10 μm, and wherein the median pore size in the upper fusible layer varies from 80 to 500 nm.

9. The method of claim 1 wherein the mean size of the fusible, polymeric particles ranges from about 200 nm to 5 μm and the median pore size in the upper fusible layer ranges from 100 to 350 nm.

10. The method of claim 1 wherein the upper fusible layer comprises fusible, polymeric particles of a thermoplastic polymer selected from the group consisting of a cellulose acetate ester, styrenic polymer, vinyl polymer, ethylene-vinyl chloride copolymer, acrylic polymer, polyurethane, poly(vinyl acetate), poly(vinylidene chloride), vinyl acetate-vinyl chloride copolymer, and copolymers thereof.

11. The method of claim 10 wherein the thermoplastic polymer is a copolymer comprising alkyl acrylate or methacrylate monomer units.

12. The method of claim 1 wherein between the fusible, porous layer and the support is at least one porous, ink-fluid-receiving layer, wherein the porous, ink-fluid-receiving layer comprises from about 50% by weight to about 95% by weight of particles and from about 50% by weight to about 5% by weight of a polymeric binder.

13. The method of claim 1 wherein a color image is printed and the printer is loaded with a plurality of inkjet pigment-based ink compositions including at least a cyan, yellow, and magenta pigment-based ink composition, at least one of the inkjet-based ink compositions comprise pigment colorant particles whose mean pigment particle size is smaller than about 80 percent of the median pore size of the upper fusible layer, but larger than 80 percent of the median pore size of the adjacent underlying ink-fluid-receiving layer, wherein the thickness of the porous fusible layer is from 1 to 50 micrometers.

14. The method of claim 13 wherein all of the cyan, yellow, and magenta pigment-based ink compositions comprise pigment colorant particles whose mean pigment particle size is smaller than about 80 percent of the median pore size of the upper fusible layer, but larger than 80 percent of the median pore size of the adjacent underlying ink-fluid-receiving layer.

15. The method of claim 1 wherein a color image is printed and the printer is loaded with a plurality of inkjet pigment-based ink compositions including at least a cyan, yellow, and magenta pigment-based ink composition, and wherein the pigment colorant particles of at least one of the inkjet-based ink compositions can be concentrated in the lower half of the fused upper layer, determinable as above with respect to the pigment colorant particles in the ink composition.

16. The method of claim 15 wherein a color image is printed and the printer is loaded with a plurality of inkjet pigment-based ink compositions including at least a cyan, yellow, and magenta pigment-based ink composition, and wherein the pigment colorant particles in all three of the inkjet-based ink compositions can be concentrated in the lower half of the fused upper layer, determinable as above with respect to the pigment colorant particles in each of the ink compositions.

17. A print made by the method of claim 1 wherein the print comprises a support and, in order upon the support, a lower porous layer and a fused upper layer comprising a continuous polymeric film comprising an image formed by said pigment-based ink.

18. A method of inkjet printing a color image on an inkjet recording element comprising:

(a) providing an inkjet printer that is responsive to digital data signals;

(b) loading the printer with a fusible inkjet recording element having a support and thereon a porous ink-fluid-receiving layer and a porous upper fusible layer, wherein the porous ink-fluid-receiving layer is an adjacent and underlying layer relative to the porous upper fusible layer, and wherein each layer is characterized by a median pore size, the median pore size of the porous upper fusible layer being greater than the median pore size of the underlying layer;

(c) loading the printer with at least one inkjet pigment-based ink composition characterized by a mean pigment particle size of pigment colorant particles in the pigment-based ink;

(d) printing on the fusible inkjet recording element using the ink composition in response to the digital data signals; and (e) fusing the printed element to obtain a fused upper layer, wherein the mean pigment particle size is smaller than about 80 percent of the median pore size of the upper fusible layer but larger than 80 percent of the median pore size of the adjacent underlying ink-fluid-receiving layer, and the thickness of the porous fusible layer is from 1 to 50 microns such that, in the printed image, the pigment colorant particles can be concentrated in the lower half relative to the upper half of the fused upper layer and substantially excluded from the underlying layer.

19. A print made by the method of claim 18 wherein the print comprises a support and, in order upon the support, a lower porous layer and a fused upper layer comprising a continuous polymeric film comprising an image formed by said pigment-based ink.

20. A method of inkjet printing a color image on an inkjet recording element comprising:

(a) providing an inkjet printer that is responsive to digital data signals;

(b) loading the printer with a fusible inkjet recording element having a support and thereon a porous ink-fluid-receiving layer and a porous upper fusible layer, wherein the porous ink-fluid-receiving layer is an adjacent and underlying layer relative to the porous upper fusible layer, and wherein each layer is characterized by a median pore size, the median pore size of the porous upper fusible layer being greater than the median pore size of the underlying layer;

(c) loading the printer with at least one inkjet pigment-based ink composition characterized by a mean pigment particle size of pigment colorant particles in the pigment-based ink;

(d) printing on the fusible inkjet recording element using the ink composition in response to the digital data signals; and (e) fusing the printed element to obtain a fused upper layer, wherein the mean pigment particle size is smaller than about 80 percent of the median pore size of the upper fusible layer but larger than 80 percent of the median pore size of the adjacent underlying ink-fluid-receiving layer, and the thickness of the porous fusible layer is from 1 to 50 microns such that, in the printed image, the pigment colorant particles can be concentrated in the lower half relative to the upper half of the fused upper layer and substantially excluded from the underlying layer.

* * * * *